US007954925B2

(12) United States Patent
Shimura

(10) Patent No.: US 7,954,925 B2
(45) Date of Patent: Jun. 7, 2011

(54) DROPLET DISCHARGING HEAD AND METHOD FOR MANUFACTURING THE SAME, AND DROPLET DISCHARGING DEVICE

(75) Inventor: Yasuto Shimura, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 959 days.

(21) Appl. No.: 11/842,526

(22) Filed: Aug. 21, 2007

(65) Prior Publication Data

US 2008/0088669 A1 Apr. 17, 2008

(30) Foreign Application Priority Data

Oct. 16, 2006 (JP) ..... 2006-281134

(51) Int. Cl.
*B41J 2/14* (2006.01)
*B41J 2/16* (2006.01)

(52) U.S. Cl. ..... 347/47; 347/86; 347/71

(58) Field of Classification Search ..... 347/47, 347/84–86, 65–71
See application file for complete search history.

(56) References Cited

U.S. PATENT DOCUMENTS 6,089,698 A * 7/2000 Temple et al. ..... 347/47

FOREIGN PATENT DOCUMENTS

| | | |
|---|---|---|
| JP | A 05-193144 | 8/1993 |
| JP | A-6-31915 | 2/1994 |
| JP | A-7-329304 | 12/1995 |
| JP | A 10-34916 | 2/1998 |
| JP | A 10-315481 | 12/1998 |
| JP | A-2002-273893 | 9/2002 |
| JP | A 2005-74635 | 3/2005 |
| JP | A 2005-231236 | 9/2005 |

* cited by examiner

*Primary Examiner* — Thinh H Nguyen
(74) *Attorney, Agent, or Firm* — Oliff & Berridge, PLC

(57) ABSTRACT

A droplet discharging head comprises: a pressure chamber; a nozzle plate including a penetration part that couples with the pressure chamber and discharges a droplet; and a droplet guidance part having a tip positioned inside the penetration part. The tip of the droplet guidance part is free from touching an inside wall of the penetration part.

14 Claims, 10 Drawing Sheets

DROPLET DISCHARGING HEAD AND METHOD FOR MANUFACTURING THE SAME, AND DROPLET DISCHARGING DEVICE

BACKGROUND

1. Technical Field

Several aspects of the present invention relate to a droplet discharging head and a method for manufacturing the same, and a droplet discharging device.

2. Related Art

A manufacturing method and its application have been proposed in which a fine pattern such as a metal wiring line is drawn by utilizing a droplet discharging technique employed in such as an inkjet printer superior in controlling a discharge amount and a drawing position.

For example, JP-A-5-193144 proposes a method with a discharging head in which discharge parts having a conical shape is formed at a droplet discharging side of the discharging head. The head improves straight-flight stability of a droplet and reduces discharged amount variation of a droplet discharged from each discharge part.

In the proposed droplet discharging head, however, it comes to be difficult to discharge a droplet correctly to a target position due to increased air resistance and the like if the droplet size is further reduced. Hence, it is hard to thoroughly secure the straight-flight stability of a droplet.

SUMMARY

An advantage of the invention is to provide a droplet discharging head capable of stabilizing a droplet discharging direction, a method for manufacturing the droplet discharging head, and a droplet discharging device having the droplet discharging head.

In the specification, a term "axisymmetric pattern" is defined as follows: when it is rotated around an axis, the pattern substantially coincides with the pattern before rotation at one or more angle within a rotation angle ranging from zero degrees to less than 360 degrees. It is interpreted that a cylindrical column has a pattern coincides at every angle. Here, the term "substantially" is defined as a case in which discharged direction, quantity, and velocity of a droplet discharged are within a predetermined error range.

Additionally, a term "peaked shape" is defined as a sharp-pointed shape. A term "truncated cone shape" is defined as a shape achieved after removing a peaked shape of a conical shape.

A droplet discharging head according to a first aspect of the invention includes a pressure chamber, a nozzle plate including a penetration part that couples with the pressure chamber and discharges a droplet, and a droplet guidance part having a tip positioned inside the penetration part. The tip of the droplet guidance part is free from touching an inside wall of the penetration part.

The head can improve droplet discharge stability.

In this case, the penetration part preferably includes a tapered shape part tapering toward a droplet discharging direction and a columnar shape part coupled with a small end of the tapered shape.

The droplet guidance part, the tapered shape part, and the cylindrical columnar part can forcibly direct a droplet in a discharging direction. Thus, straight-flying stability of a droplet can be further improved.

In this case, the tapered shape part preferably has a truncated cone shape part tapering toward the droplet discharging direction. The columnar shape part preferably has a cylindrical columnar shape coupled with a small end of the truncated cone shape part. The truncated cone shape part and the columnar shape part are preferably disposed coaxially or eccentrically.

The highly symmetric pattern formed in the penetration part can forcibly direct a droplet in an axis direction when the axes are coaxially aligned and the droplet is discharged in the axis direction. Thus, controlling a droplet landing position can be improved. Although the axes are eccentrically disposed, the discharging direction is highly repeatable. As a result, fluctuation of the landing position can be suppressed.

In this case, the penetration part preferably includes a first columnar shape part that is disposed to a first surface, which faces the pressure chamber, of the nozzle plate and has a first cross-sectional shape, and a second columnar shape part that is disposed to a discharging surface of the nozzle plate and has a second cross-sectional shape.

The droplet guidance part is disposed inside the first columnar shape part to adjust a sectional area to manages the following problems: the volume difference between the first and second columnar shape parts, and occurrence and gathering of bubbles produced by a step at their connection part in a droplet discharging head formed by combining columnar shapes. The droplet guidance part can reduce the volume difference and improve discharge performance.

In this case, the first columnar shape part is preferably a first cylindrical columnar shape having a first radius, and the second columnar shape part is preferably a second cylindrical columnar shape having a second radius smaller than the first radius. The first columnar shape part and the second columnar shape part are preferably disposed coaxially or eccentrically.

The droplet discharging head formed with shapes having a highly symmetric pattern can improve the straight-flight stability of a droplet. Although the axes are eccentrically disposed, the discharging direction is highly repeatable. As a result, fluctuation of the landing position can be suppressed.

In this case, the droplet guidance part preferably includes an axisymmetric pattern.

Since the droplet guidance part has the axisymmetric pattern, a droplet is discharged symmetrically with respect to the axis. As a result, a droplet landing position can be controlled with high accuracy.

In this case, the tip of the droplet guidance part is preferably positioned within a thickness of the nozzle plate.

The head can reduce the fluctuation of a droplet discharging direction and adjust a volume change in the penetration part. As a result, discharge stability can be improved.

In this case, the droplet guidance part is preferably disposed within the thickness of the nozzle plate, and the axisymmetric pattern preferably includes a peaked shape tapering toward the droplet discharging direction, a truncated cone shape tapering toward the droplet discharging direction, a cylindrical columnar shape, and a shape having a bulging part.

According to the structure, a droplet is easily released at the tip of the droplet guidance part formed in the above shape when discharged. Since the droplet is released at the tip of the droplet guidance part, influence of the shape of the droplet guidance part can be reduced when the droplet is discharged.

In this case, the droplet guidance part preferably has a first support supporting the droplet guidance part and fixing the droplet guidance part to the first surface of the nozzle plate.

According to the structure, since the droplet discharge part is fixed to the nozzle plate via the first support, the length of the first support can be within the length ranging from the outer circumference of the penetration part to the droplet guidance part. Therefore, stress received by the first support can be reduced by shortening the first support based on the principle of leverage when force is applied to discharge a droplet to the droplet guidance part or to manufacture the droplet guidance part. As a result, a droplet discharging head having high reliability can be provided.

In this case, the droplet guidance part preferably has a second support extending toward the pressure chamber so as to be fixed on a wall of the pressure chamber. The wall faces the nozzle plate.

In the structure, the droplet guidance part is fixed to the wall of the pressure chamber via the second support. Therefore, a mechanism to maintain the positional relationship between the nozzle plate and the droplet guidance part can be disposed at a position away from a part related to the discharge of a droplet. As a result, a structure can be provided that can suppress the occurrence of a turbulent flow in a region in which a droplet is discharged.

In this case, the droplet guidance part preferably has a second support that extends toward the pressure chamber and bends or branches in the pressure chamber so as to be fixed on a sidewall of the pressure chamber.

In the structure, the droplet guidance part is, likewise the above, fixed to the sidewall of the pressure chamber via the second support. Therefore, a mechanism to maintain the positional relationship between the nozzle plate and the droplet guidance part can be disposed at a position away from a part related to the discharge of a droplet. As a result, a structure can be provided that can suppress the occurrence of a turbulent flow in a region in which a droplet is discharged.

According to a second aspect of the invention, a method for manufacturing the droplet discharging head according to the first aspect of the invention includes forming the droplet guidance part having the first support, and fixing the first support on the first surface of the nozzle plate.

Since the droplet guidance part is fixed to the nozzle plate via the first support, the position of either one of the droplet guidance part and the nozzle plate is fixed, and then the other is fixed after adjusting the position. Therefore, they can easily be positioned.

According to a third aspect of the invention, a method for manufacturing the droplet discharging head according to the first aspect of the invention includes forming the droplet guidance part and the second support and fixing the droplet guidance part on the wall of the pressure chamber with the second support interposed between the droplet guidance part and the wall.

Since the droplet guidance part is fixed to the wall of the pressure chamber with the second support, a mechanism to maintain the positional relationship between the nozzle plate and the droplet guidance part is away from a part related to discharge a droplet. The method can be provided that realizes the structure in which the occurrence of a turbulent flow is suppressed by using the step to fix the second support to a position away from the nozzle plate.

In this case, the droplet guidance part having the first support and the droplet guidance part having the second support are preferably formed by using one of a dry etching method, a light-forming method, and an ion beam forming method.

The method can provide a step in which a number of droplet guidance parts are manufactured in a short time when the dry etching method is used as a method for manufacturing a droplet discharging head in the step to manufacture the droplet guidance part having the first or second support. Because, the dry etching method can form a number of droplet guidance parts simultaneously. Using the light-forming method can achieve a droplet guidance part having a complicated shape that is hardly manufactured by other methods, providing a manufacturing step of a droplet guidance part having an excellent controllability of a droplet. In addition, using the ion beam forming method can form a droplet guidance part by using a material to which the dry etching method and the light-forming method are hardly applied, providing a manufacturing step of a droplet guidance part using various materials.

A droplet discharging device according to a fourth aspect of the invention includes the droplet discharging head according to the first aspect of the invention.

The droplet discharging device can achieve highly accurate drawings since the droplet discharging head is included that discharges a droplet with highly landing accuracy.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1A:
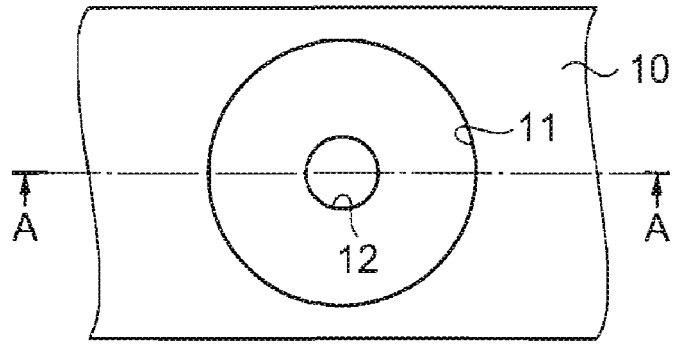
FIG. 1A is a plan view illustrating a nozzle plate including a truncated cone shape part and a cylindrical columnar part.
Figure 1B:
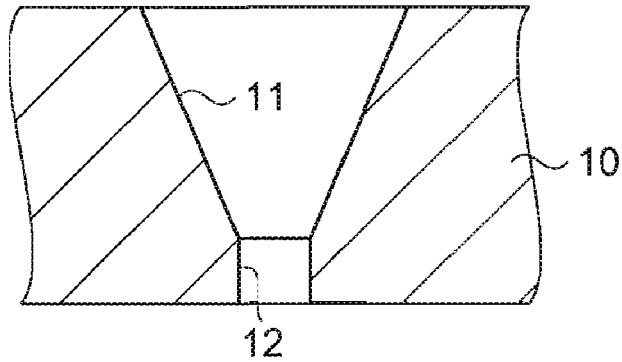
FIG. 1B is a sectional view taken along the line A-A of FIG. 1A.
Figure 2A:
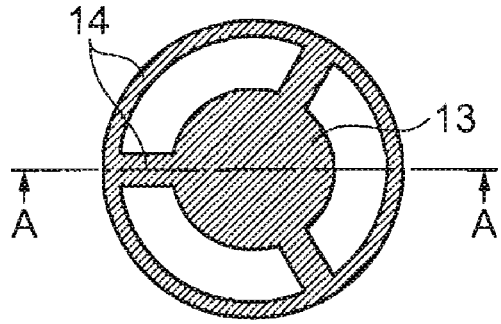
FIG. 2A is a plane view illustrating a droplet guidance part having an axisymmetric pattern.
Figure 2B:
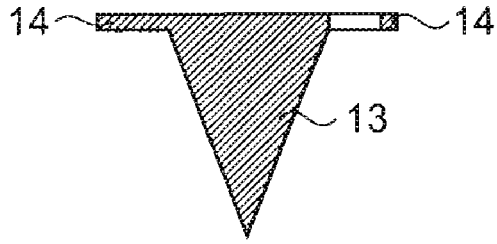
FIG. 2B is a sectional view taken along the line A-A of FIG. 2A.
Figure 3A:
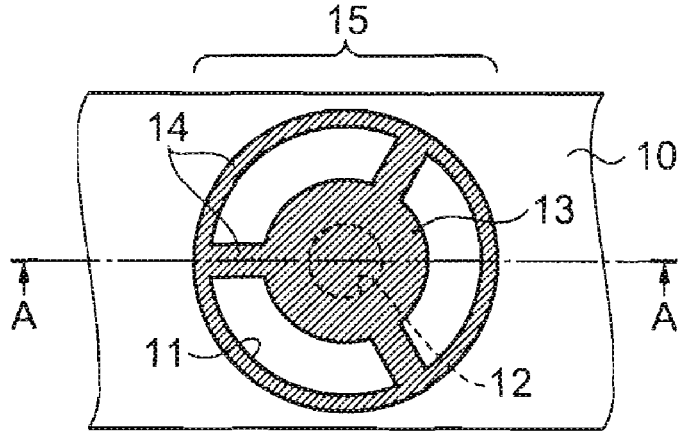
FIG. 3A is a plane view illustrating a discharge part of a droplet discharging head in which the droplet guidance part is overlapped on the nozzle plate.
Figure 3B:
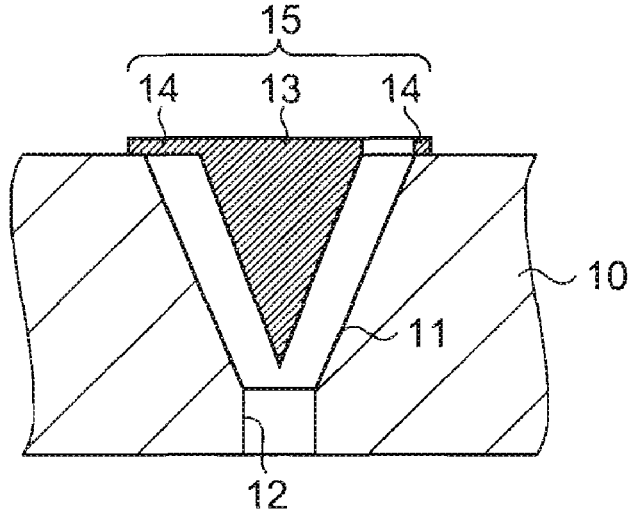
FIG. 3B is a sectional view taken along the line A-A of FIG. 3A.

As a first embodiment of the invention, a schematic structure and a forming method of a nozzle plate will be described with reference to the following drawings. The nozzle plate includes a truncated cone shape as a tapered shape part and a cylindrical columnar shape disposed at a side adjacent to a small opening diameter of the truncated cone shape. FIG. 1A is a plane view illustrating a nozzle plate. The nozzle plate includes a truncated cone shape part having a truncated cone shape (a shape after removing a peaked part, from a conical shape) and a cylindrical columnar shape part connected to the small end of the truncated cone shape, and has an axisymmetric pattern. FIG. 1B is a sectional view taken along the line A-A of FIG. 1A. FIG. 2A is a plane view illustrating a droplet guidance part having an axisymmetric pattern. FIG. 2B is a sectional view taken along the line A-A of FIG. 2A. FIG. 3A is a plane view illustrating a discharge part of a droplet discharging head in which the droplet guidance part is overlapped on the nozzle plate. FIG. 3B is a sectional view taken along the line A-A of FIG. 3A.

As shown in FIG. 1A, a nozzle plate 10 has a truncated cone shape part 11 and a cylindrical columnar part 12 both of which serve as a penetration part. FIG. 1B, the sectional view taken along the line A-A, shows the relative position between the truncated cone shape part 11 and the cylindrical columnar part 12. A droplet is supplied from the truncated cone shape part 11 and discharged through the cylindrical columnar part 12. A droplet guidance part 13 having a conical shape, shown in FIGS. 2A and 2B, is coaxially arranged and fixed to the truncated cone shape part 11 and the cylindrical columnar part 12, both of which are shown in FIG. 1B, of the nozzle plate 10 with a first support 14 supporting the droplet guidance part 13. As a substitute of the truncated cone shape part 11, another member may be used that has a shape having different curvatures such as a horn shape. Here, a circular constructional member of the first support 14 can be omitted. The constructional member can employ another shape, which will be described later as a fourth modification. FIGS. 3A and 3B show a discharge part 15 included in a droplet discharging head, which is formed by coaxially arranging the droplet guidance part 13 to the truncated cone shape part 11 and the cylindrical columnar part 12 of the nozzle plate 10. The droplet guidance part 13 is disposed so that the tip thereof is positioned in the vicinity of the border between the truncated cone shape part 11 and the cylindrical columnar part 12, and the tip does not touch any of the sidewalls of the truncated cone shape part 11 and the cylindrical columnar part 12, guiding a droplet onto the axes of the truncated cone shape part 11 and the cylindrical columnar part 12. The tip of the droplet guidance part 13 can be disposed inside the truncated cone shape part 11 and the cylindrical columnar part 12. The axis of the droplet guidance part 13 is coaxially arranged and fixed to the axes of the truncated cone shape part 11 and the cylindrical columnar part 12. In this regard, other arrangements than the coaxial arrange can be employed as long as discharging a droplet can be controlled.

Figure 4:
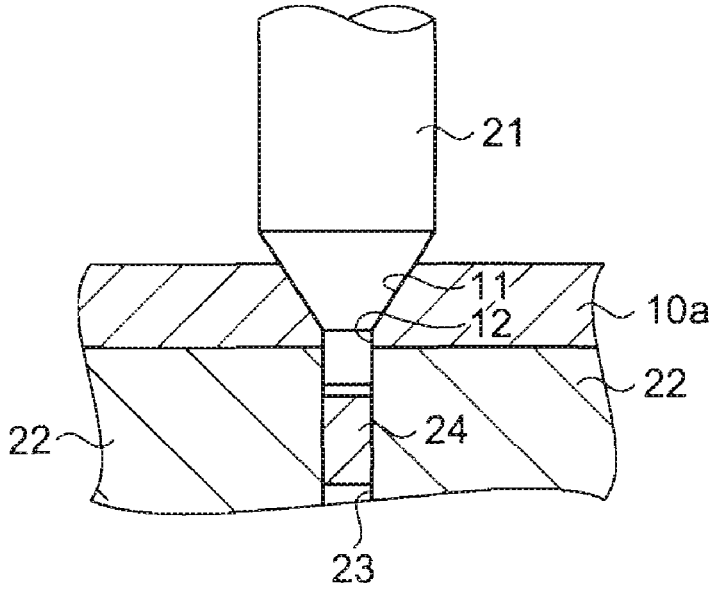
FIG. 4 is a sectional view illustrating a manufacturing step of a nozzle plate including a truncated cone shape part and a cylindrical columnar part.

Next, a method for manufacturing the truncated cone shape part 11 and the cylindrical columnar part 12 shown in FIGS. 1A and 1B will now be described. As a material for a nozzle plate material 10a, a stainless steel can be exemplified. FIG. 4 is a sectional view illustrating a method for manufacturing a nozzle plate having the truncated cone shape part 11 and the cylindrical columnar part 12. FIG. 4 shows a punch 21 having a shape of the combination of the truncated cone shape and the cylindrical columnar shape, and a die having a hole 23. The hole 23 has an inner diameter slightly larger than that of the cylindrical columnar part of the punch 21 so that a punched slug 24 after punching the nozzle plate material 10*a* with the punch 21 can go through the hole 23.

First, the nozzle plate material 10*a* is set to the die 22. Then, the punch 21 is touched to the nozzle plate material 10*a* and the cylindrical columnar shape part of the punch 21 is forced to penetrate the nozzle plate material 10*a*. The punched slug 23 produced during the penetration is passed through the hole 23. Through the step, the cylindrical columnar part 12 is formed. Simultaneously, the truncated cone shape part 11 is formed by being pressed with the truncated cone shape of the punch 21. As a result, the nozzle plate 10 (refer to FIGS. 1A and 1B) is made using the nozzle plate material 10*a*.

Since the tip of the droplet guidance part 13 is positioned in the truncated cone shape part 11, a droplet is released at the tip of the droplet guidance part 13 and discharged when the droplet is discharged. The influence of the shape of the droplet guidance part 13 is relaxed in discharging a droplet and a droplet is disposed at a position to be discharged by the droplet guidance part 13 since the droplet is released at the tip. Thus, the droplet is discharged with having straight flying property. As a result, variation in a droplet discharging direction can be suppressed.

Second Embodiment

Figure 5A:
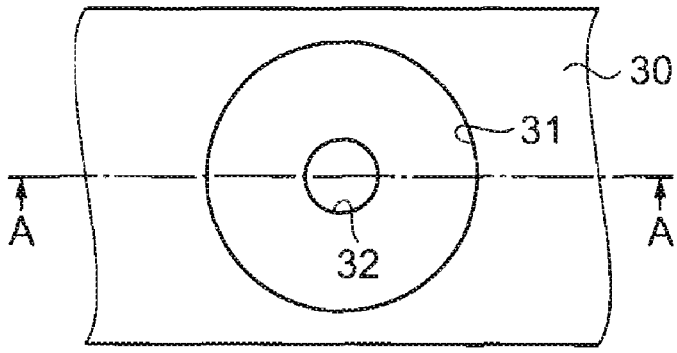
FIG. 5A is a plane view illustrating a nozzle plate that has a first cylindrical columnar part, a second cylindrical columnar part, and an axisymmetric pattern. The second cylindrical columnar part has a radius smaller than that of the first cylindrical columnar part and is combined with the first cylindrical columnar part.
Figure 5B:
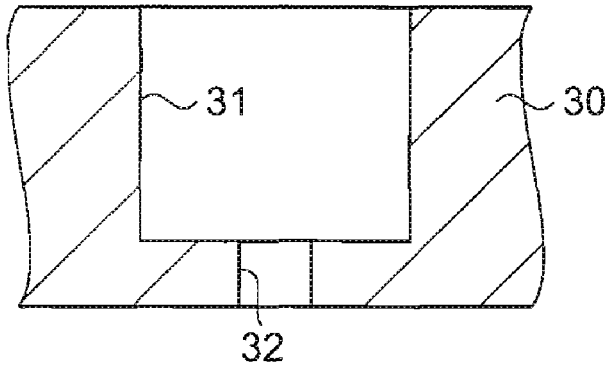
FIG. 5B is a sectional view taken along the line A-A of FIG. 5A.
Figure 6A:
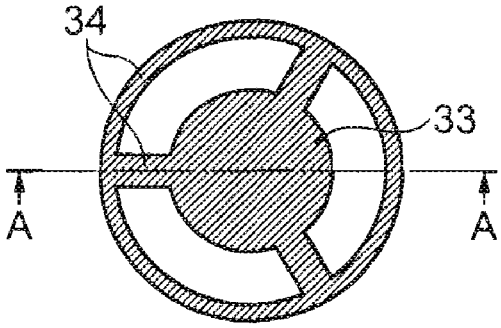
FIG. 6A is a plan view illustrating a droplet guidance part having an axisymmetric pattern.
Figure 6B:
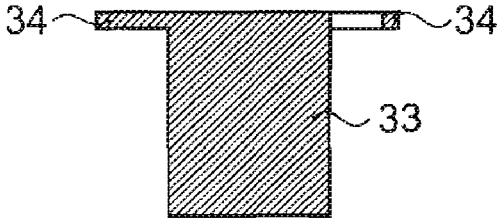
FIG. 6B is a sectional view taken along the line A-A of FIG. 6A.
Figure 7A:
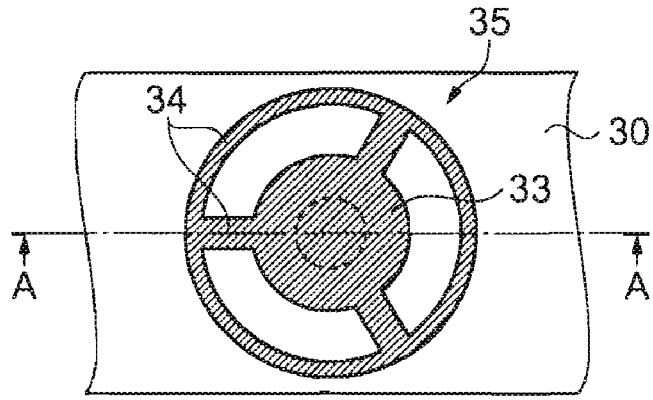
FIG. 7A is a plane view illustrating a discharge part included in a droplet discharging head in which the droplet guidance part is overlapped on the nozzle plate.
Figure 7B:
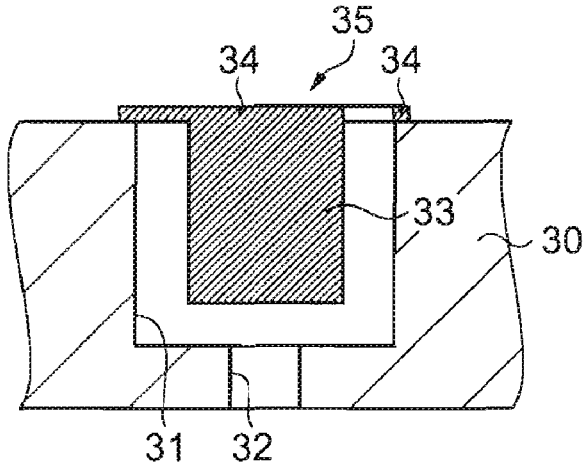
FIG. 7B is a sectional view taken along the line A-A of FIG. 7A.

An example in which two cylindrical columnar parts, each having a different radius, are disposed in a nozzle plate will be described as a second embodiment with reference to the accompanying drawings. FIG. 5A is a plane view illustrating a nozzle plate that has a first cylindrical columnar part, a second cylindrical columnar part, and an axisymmetric pattern. The second cylindrical columnar part has a radius smaller than that of the first cylindrical columnar part and is combined with the first cylindrical columnar part. FIG. 5B is a sectional view taken along the line A-A of FIG. 5A. FIG. 6A is a plane view illustrating a droplet guidance part having an axisymmetric pattern. FIG. 6B is a sectional view taken along the line A-A of FIG. 6A. FIG. 7A is a plane view illustrating a discharge part included in a droplet discharging head in which the droplet guidance part is overlapped on the nozzle plate. FIG. 7B is a sectional view taken along the line A-A of FIG. 7A.

As shown in FIGS. 5A and 5B, a nozzle plate 30 has a first cylindrical columnar part 31 and a second cylindrical columnar part 32 both of which serve as a penetration part. A droplet is supplied from the first cylindrical columnar part 31 and discharged through the second cylindrical columnar part 32.

A droplet guidance part 33 having a cylindrical columnar shape as an axisymmetric pattern, shown in FIGS. 6A and 6B, is coaxially arranged and fixed to the first cylindrical columnar part 31 and the second cylindrical columnar part 32, shown in FIGS. 5A and 5B, of the nozzle plate 30 with a first support 34 supporting the droplet guidance part 33. Here, a circular constructional member of the first support 34 can be omitted. The constructional member can employ another shape, which will be described later as the fourth modification.

As shown in FIGS. 7A and 7B, the droplet guidance part 33 is disposed inside the first cylindrical columnar part 31 of the nozzle plate 30 so as to penetrate the nozzle plate 30, thereby forming a discharge part 35 included in a droplet discharging head. The droplet guidance part 33 of the discharge part 35 included in a droplet discharging head is disposed so that the tip thereof is positioned in the vicinity of the border between the first cylindrical columnar part 31 and the second cylindrical columnar part 32, and the tip does not touch any of the sidewalls of the first cylindrical columnar part 31 and the second cylindrical columnar part 32, guiding a droplet onto the axes of the first cylindrical columnar part 31 and the second cylindrical columnar part 32. The tip of the droplet guidance part 33 can be disposed inside the first cylindrical columnar part 31 and the second cylindrical columnar part 32. This arrangement in which the axis of the droplet guidance part 33 is coaxially disposed to the axes of the first cylindrical columnar part 31 and the second cylindrical columnar part 32 can achieve a structure having high symmetric property. In this regard, other arrangements than the coaxial arrange can be employed as long as discharging a droplet can be controlled.

Figure 8A:
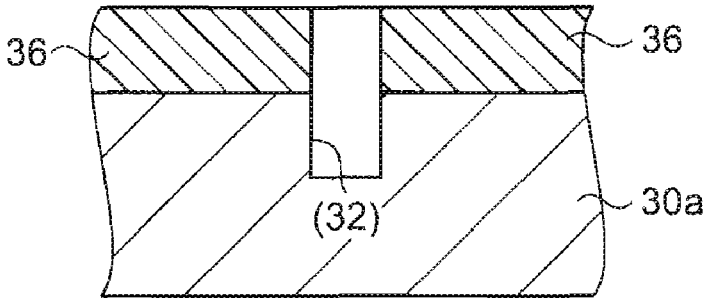
FIGS. 8A and 8B are sectional views illustrating steps for manufacturing the first cylindrical columnar part and the second cylindrical columnar part.
Figure 8B:
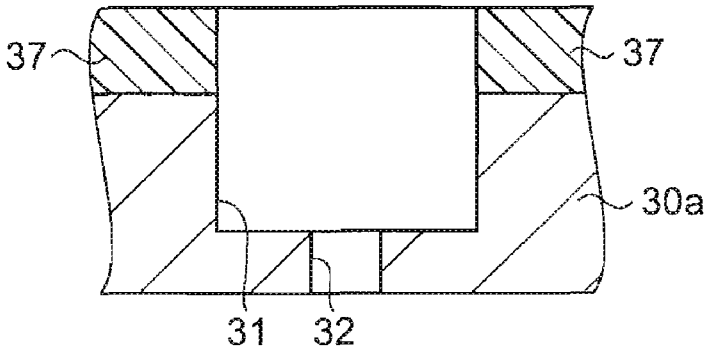

Next, a method for manufacturing the first cylindrical columnar part 31 and the second cylindrical columnar part 32, both of which are shown in FIGS. 5A and 5B, will be described. As a material for a nozzle plate material 30*a*, a silicon substrate can be exemplified. FIG. 8A and 8B are sectional views illustrating steps for manufacturing the first cylindrical columnar part 31 and the second cylindrical columnar part 32.

First, as shown in FIG. 8A, a photoresist layer 36 is formed as a pattern on the nozzle plate material 30*a*. Then, an area corresponding to the second cylindrical columnar part 32 is etched.

Next, the photoresist layer 36 is removed and a photoresist layer 37 is anew formed as shown in FIG. 8B. Then, an area corresponding to the first cylindrical columnar part 31 is etched. The order of forming the first cylindrical columnar part 31 and the second cylindrical columnar part 32 does not necessarily follow the above order, but the first cylindrical columnar part 31 may be formed first. Alternatively, the second cylindrical columnar part 32 may be formed from a surface opposite to a surface on which the first; cylindrical columnar part 31 is formed.

Additionally, they may be formed, by using a technique described in the first embodiment, with a punch and a die. In this case, a ductile material such as a stainless steel is preferably used as a material for the nozzle plate.

The volume difference or a step at the border between the first cylindrical columnar part 31 and the second cylindrical columnar part 32 may cause an occurrence and gathering of bubbles, adversary affecting discharge stability. Positioning the tip of the droplet guidance part 33 inside the first cylindrical columnar part 31 can reduce the volume difference and control the change of a meniscus position smoothly. As a result, discharge performance and continuous discharge performance can be improved. When a structure is employed in which a bulging part is provided inside the first cylindrical columnar part 31, the volume difference between the first cylindrical columnar part 31 and the second cylindrical columnar part 32 can be suppressed. Further, a tapered shape extending toward a discharging direction of a droplet in the structure can more stabilize the discharging direction.

Third Embodiment

A third embodiment of the invention will be described below. In the embodiment, a wiring material used for forming a wiring pattern by a droplet discharge method, the droplet discharge method, and a hardening treatment of the wiring material will be described in this order before describing a distinctive method for manufacturing a droplet discharging head.

Wiring Material

As a wiring material for forming a wiring pattern by a droplet discharge method, a dispersed solution is used in which conductive fine particles are dispersed in a dispersion medium. According to the embodiment, examples of the conductive fine particles may include: metal fine particles containing any of gold, silver, copper, iron, chromium, manganese, molybdenum, titanium, palladium, tungsten, and nickel; their oxides; and fine particles of a conductive polymer or a super-conductive material. These conductive fine particles may be used by coating their surfaces with an organic matter or the like to improve their dispersibility. The diameter of the conductive fine particle is preferably in the range from 1 nm to 0.1 μm inclusive. Using conductive fine particles having a diameter 0.1 μm or less can prevent the discharge part of a droplet discharging head from being clogged. Using conductive fine particles having a diameter 1 nun or more can control the volume ratio of a coating agent to the conductive fine particles in an adequate range. As a result, the proportion of an organic matter contained in the resulting film can be controlled in an adequate range.

Here, any dispersion medium can be used as long as it is capable of dispersing the above conductive fine particles and suppressing the aggregation of the particles. As the dispersion medium, the following hydrocarbon compounds can be exemplified: alcohols such as methanol, ethanol, propanol, and butanol; n-heptane, n-octane, decane, dodecane, tetradecane, toluene, xylene, cymene, durene, indene, dipentene, tetrahydronaphthalene, decahydronaphthalene, and cyclohexylbenzene, in addition to water, The following ether type compounds also can be exemplified: ethylene glycol dimethyl ether, ethylene glycol diethyl ether, ethylene glycol methyl ethyl ether, diethylene glycol dimethyl ether, diethylene glycol diethyl ether, diethylene glycol methyl ethyl ether, 1,2-dimethoxyethane, bis(2-methoxyethyl) ether, and p-dioxane.

Further, the following polar compounds can be exemplified: propylene carbonate, γ-butyrolactone, N-methyl-2-pyrrolidone, dimethyl formamide, dimethyl sulfoxide, and cyclohexanone.

Water, alcohols, hydrocarbon compounds, and ether compounds are preferably used in terms of particle dispersibility, dispersed solution stability, and applicability to a droplet discharge method. Among others, water and hydrocarbon compounds are more preferably used.

The surface tension of the dispersed solution of the conductive fine particles is preferably within the range from 0.02 N/m to 0.07 N/m inclusive. When a droplet L is discharged by a droplet discharge method, maintaining the surface tension 0.02 N/m or more can suppress the wettability of a functional liquid composition with respect to the surface of the discharge part. As a result, an occurrence of a flight curve can be prevented. In contrast, maintaining the surface tension 0.07 N/m or less can stabilize the meniscus shape at the tip the discharge part. As a result, a discharge amount and discharge timing can be precisely controlled.

In order to adjust the surface tension, a fluorine-, silicone- or nonionic-based surface tension adjuster, for example, may be added in a small amount to the dispersed solution in a range not largely lowering a contact angle with respect to a substrate. The nonionic surface tension adjuster enhances the wettability of a liquid with respect to a substrate, improves the leveling property of a film, and serves to prevent minute concavities and convexity of the film from being formed. The surface tension adjuster may include, if necessary, organic compounds, such as alcohol, ether, ester, and ketone.

The viscosity of the dispersed solution is preferably within the range from 1 mPa·s to 50 mPa·s inclusive. When a liquid material is discharged as the droplet L by using a droplet discharge method, maintaining the viscosity 1 mPa·s or more can prevent a functional liquid from flowing out to the periphery of the discharge part. As a result, contamination can be prevented. In contrast, maintaining the viscosity 50 mPa·s or less prevents the discharge part from being clogged. As a result, a smooth discharge can be achieved.

Droplet Discharge Method

As the discharge technique of a droplet discharge method, an inkjet method is preferably used that can form fine patterns in an on-demand manner. Examples of the inkjet method include electromechanical converting and electrostatic driving methods. The electromechanical converting method utilizes the characteristic of a piezo element (piezoelectric element) that it is deformed in response to a pulsed electric signal. In the method, the deformation of the piezo element applies pressure, via an elastic material, to a space storing a material, pushing the material out of the space to discharge it from a discharge part. In the electrostatic driving method, pressure produced by attractive and repulsive forces of electrostatic charges is applied to a space in which a material is stored via a flexible material so as to push out the material from the space, thereby discharging the material from a discharge part. Other than the above methods, a thermal method using a heater can be used as a droplet discharge method.

The droplet discharge method has an advantage in that a desired amount of a material can be adequately disposed to a desired location with little waste of the material. An amount of a liquid material droplet discharged by the droplet discharge methods is, for example, from 1 to 300 nanograms.

Hardening Treatment of the Wiring Material

A hardening treatment of the wiring material, called as a firing treatment, is usually carried out in the atmosphere. The treatment also can be performed in an environment of an inert gas, such as nitrogen, argon, and helium, if necessary. The processing temperature for the firing treatment will be determined at an appropriate level, taking into account the boiling point (vapor pressure) of the dispersion medium., the type and pressure of the atmospheric gas, thermal behavioral properties such as the dispersibility and oxidizability of fine particles, the existence and volume of coating material, and the base material heat resistance temperature, or the like. In the embodiment, the wiring material is subjected to a firing treatment under the following conditions: at 200° C., for about 60 minutes, and with a clean oven in the atmosphere. Through the above treatment, wiring layers (not shown) can be formed to secure an electrical contact between fine particles.

Such firing treatment can be conducted with a hot plate or an electric furnace. Alternatively, lamp annealing can also be employed. Examples of light sources for lamp annealing are not limited to but include: an infrared lamp, a xenon lamp, YAG laser, argon laser, carbon dioxide laser, and excimier laser of XeF, XeCl, XeBr, KrF, IrCl, ArF, ArCl, or the like. The light sources generally have a power ranging from 10 W to 5000 W inclusive, but for the embodiment it is sufficient to provide the range from 100 W to 1000 W inclusive. As described above, a wiring material is disposed by using a droplet discharge method, and then the wiring material is hardened to form a desired wiring pattern.

Fourth Embodiment

As a fourth embodiment, a method for manufacturing a droplet guidance part by using a dry etching method will be described below with reference to the accompanying drawings. FIGS. 9A to 12A are plan views illustrating manufacturing steps of a droplet guidance part. FIGS. 9B to 12B are sectional views taken along the line A-A of respective plan views.

Figure 9A:
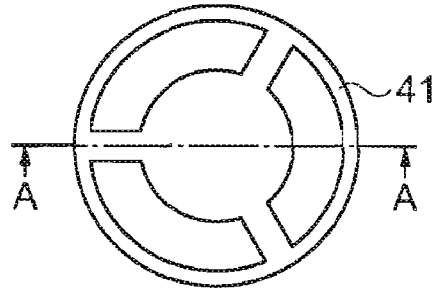
FIG. 9A is a plan view illustrating a step for manufacturing a droplet guidance part.
Figure 9B:
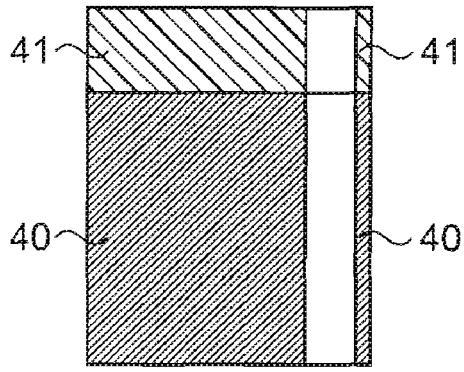
FIG. 9B is a sectional view taken along the line A-A of FIG. 9A.

First, as step 1 shown in FIGS. 9A and 9B, a photoresist layer 41 is formed on a silicon substrate 40 as a pattern having a fun shape. Then, the silicon substrate 40 is anisotropic etched by using the photoresist layer 41 as a mask to form a fun-shape hole penetrating the silicon substrate 40.

Figure 10A:
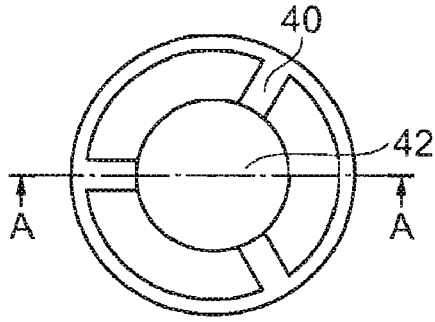
FIG. 10A is a plan view illustrating a step for manufacturing a droplet guidance part.
Figure 10B:
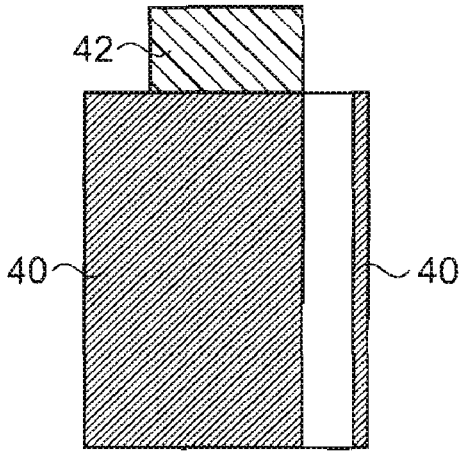
FIG. 10B is a sectional view taken along the line A-A of FIG. 10A.

Next, as step 2 shown in FIGS. 10A and 10B, the photoresist layer 41 is etched so as to be removed. Then, a photoresist layer 41 having a cylindrical columnar shape is anew formed on the central part, surrounding of which is etched off in a fun shape, of the silicon substrate 40.

Figure 11A:
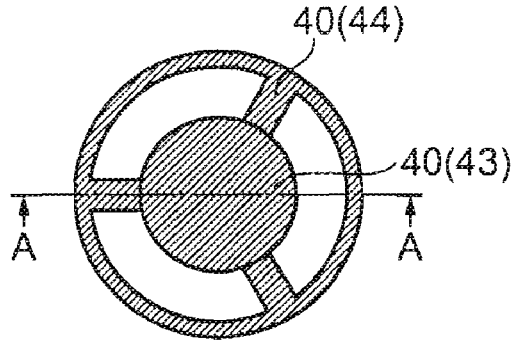
FIG. 11A is a plan view illustrating a step for manufacturing a droplet, guidance part.
Figure 11B:
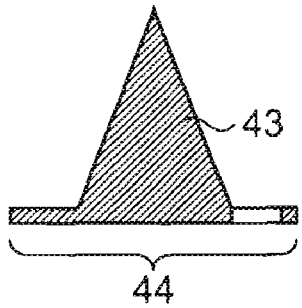
FIG. 11B is a sectional view taken along the line A-A of FIG. 11A.

Next, as step 3 shown in FIGS. 11A and 11B, the silicon substrate 40 is etched with the photoresist layer 42 as a mask. Etched with an etching condition by which the silicon substrate 40 is anisotropic etched and the side surface of the photoresist layer 42 is gradually etched, the silicon substrate 40, located under the photoresist layer 42, can be shaped in a tapered form.

With the above etching condition, a droplet guidance part 43 having a conical shape, and a first support 44 are formed as an axisymmetric pattern having a peaked shape. Here, a circular constructional member of the first support 44 can be omitted. For example, it can be removed simultaneously when the silicon substrate 40 is etched in a fun shape of step 2. The constructional member can employ another shape, which will be described later as the fourth modification. When the photoresist layer 42 remains since it is not thoroughly etched during processing the silicon substrate 40 in a tapered form, the remains is removed by an additional step. The droplet guidance part 13, used in the first embodiment and shown in FIGS. 3A and 3B, can be manufactured by the method.

Alternatively, dry etching may be employed in which used are silicon oxide as a substitute for the silicon substrate 40, a nickel mask as a substitute for the photoresist layer 42, and a mixed gas of carbon tetrafluoride, difluoromethane, and oxygen as an etching gas. Using such materials and gases also can achieve a tapered shape.

Figure 12A:
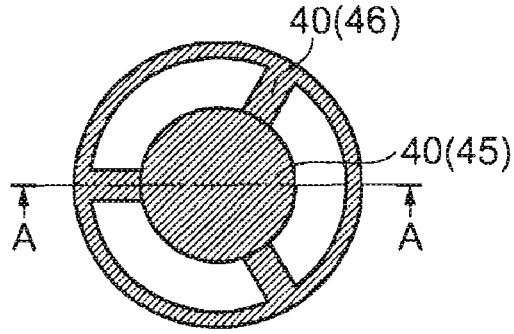
FIG. 12A is a plan view illustrating a step for manufacturing a droplet guidance part.
Figure 12B:
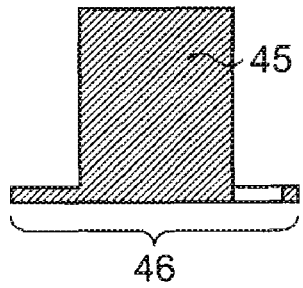
FIG. 12B is a sectional view taken along the line A-A of FIG. 12A.

As another manner in step 3, a droplet guidance part 45 and a first support 46 shown in FIGS. 12A and 12B are formed by performing an anisotropic etching with covering the side surface of the photoresist layer 49. The droplet guidance part 33, which includes a cylindrical columnar shape having an axisymmetric pattern as shown in FIGS. 7A and 7B and is used in the second embodiment, can be manufactured by the method.

Here, a circular constructional member of the first support 46 can be omitted. For example, it can be removed simultaneously when the silicon substrate 40 is etched in a fun shape of step 2. The constructional member can employ another shape, which will be described later as the fourth modification.

As shown in FIGS. 3A and 3B, the droplet guidance part 13 formed by the above steps can form a discharge part included in a droplet discharging head by fixing the first support 14 on the droplet supply side surface of the nozzle plate 10.

Likewise, as shown in FIGS. 7A and 7B, the droplet guidance part 33 formed by the above steps can form a discharge part included in a droplet discharging head by fixing the first support 34 on the droplet supply side surface of the nozzle plate 30.

Fifth Embodiment

As a fifth embodiment, a method for manufacturing a droplet guidance part by using a light-forming method or an ion beam method will be described below with reference to the accompanying drawings. FIGS. 13A to 13D are sectional views illustrating manufacturing steps using a light-forming technique in order to cope with a case in which a droplet guidance part, used for a discharge part included in a droplet discharging head, has a complicated shape. In the embodiment, a droplet guidance part 52, shown in FIG. 13D, having a part of a bulging shape is formed.

Figure 13A:
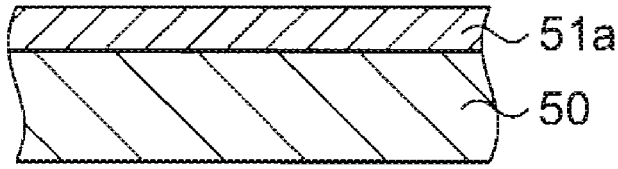
FIGS. 13A through 13D are sectional views illustrating steps for manufacturing a droplet discharging head by using a light-forming technique.

First, as step 1 shown in FIG. 13A, a light curing resin 51*a* is coated so as to cover a first surface of a substrate 50.

Figure 13B:
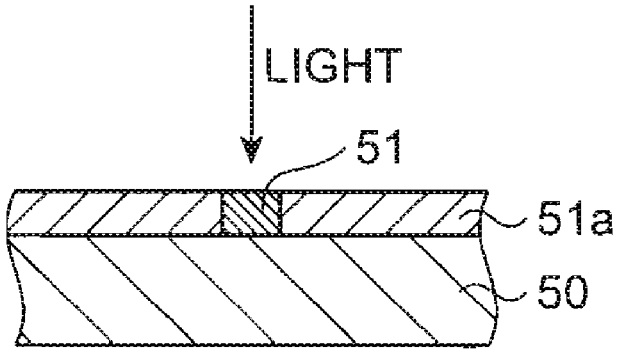

Next, as step 2 shown in FIG. 13B, a desired area is irradiated with light to be cured. As a result, a light cured part 51 is formed, Then, as step 3 shown in FIG. 13C, the light curing resin 51*a* is removed while the light cured part 51 remains.

Figure 13C:
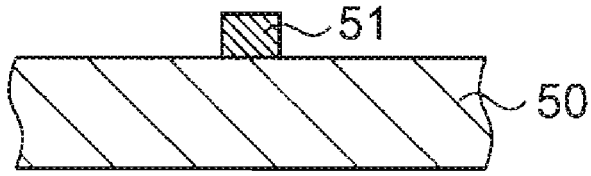
Figure 13D:
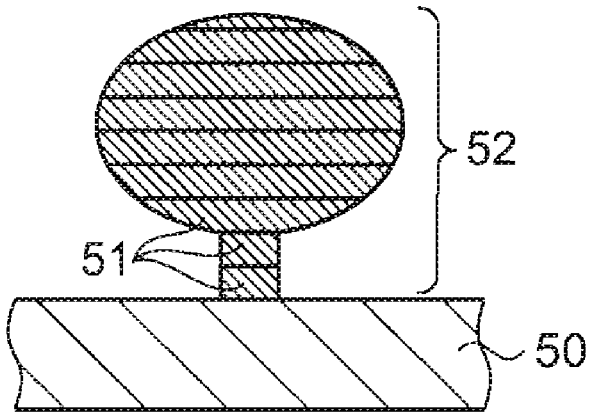

By repeating the above steps shown in FIGS. 13A to 13C, a droplet guidance part 52 having a desired shape (a bulging shape in the embodiment) can be achieved as shown in FIG. 13D. The light-forming technique can form all shapes, which will be described in a second modification, in addition to the droplet guidance part 13 formed in the first embodiment, and the droplet guidance part 33 formed in the second embodiment.

Here, an ion beam etching may be used for forming complicated structures. Using a transport-positioning mechanism that relatively changes an ion beam irradiation position can form complicated structures. Processing by using ion beams makes it possible to choose metal as a material to be etched. Since metal shows less aging change, a higher reliable droplet guidance part can be formed.

Sixth Embodiment

Figure 14A:
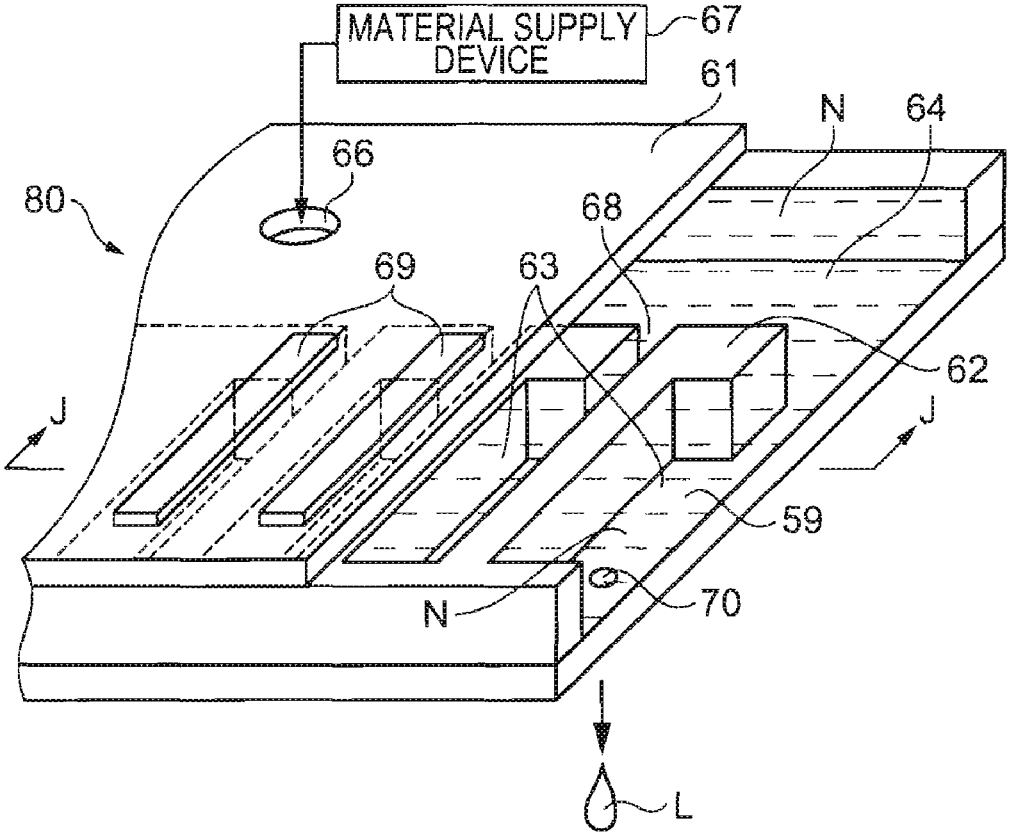
FIG. 14A is a schematic perspective view illustrating the major part of a structure including a droplet discharging head.
Figure 14B:
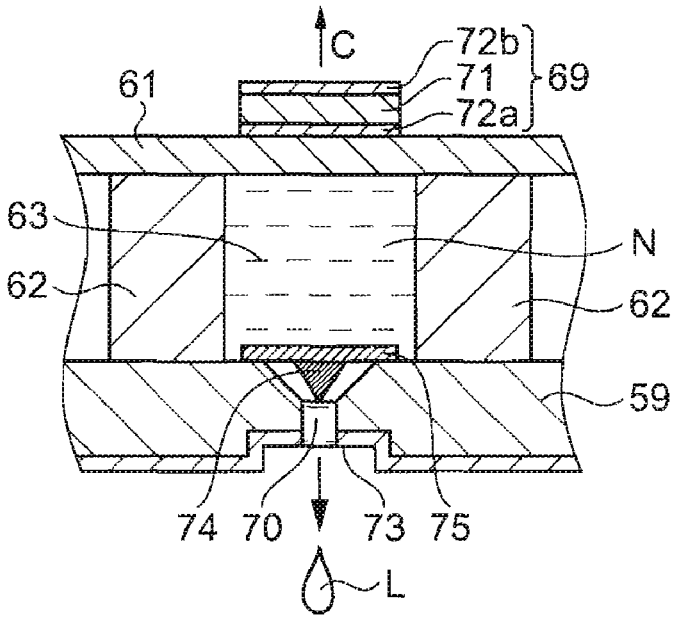
FIG. 14B is a schematic sectional view.

As a sixth embodiment, a structure of a droplet discharging head mounted in a droplet discharging device will be described below with reference to the accompanying drawings. FIGS. 14A and 14B show a major part of a structure including s droplet discharging head. FIG. 14A is the schematic perspective view of the structure. FIG. 14B is the schematic sectional view of the structure.

As shown in FIG. 14A, a droplet discharging head 80 includes a nozzle plate 59 made of a stainless steel or the like, a vibration plate 61 facing the nozzle plate 59, and a partition 62 interposed between the nozzle plate 59 and the vibration plate 61 to bond them. Between the nozzle plate 59 and the vibration plate 61, formed are a plurality of pressure chambers 63 and a liquid reservoir 64 with the partition 62. The plurality of pressure chambers 63 communicates with the liquid reservoir 64 through a passage 68.

The vibration plate 61 has a material supply hole 66. A material supply device 67 is connected to the material supply hole 66. The material supply device 67 supplies a material N containing a wiring material and the like to the material supply hole 66. The supplied material N fully fills in the liquid reservoir 64 and further fully fills the pressure chambers 63 after passing though the passage 68. In FIG. 14A, a penetration part 70 is shown simplified as a cylinder hollow shape. The detailed structure adjacent to the penetration part 70 is shown in FIG. 14B.

As shown in FIG. 14B, the nozzle plate 59 has the penetration part 70 to discharge the material N from the pressure chamber 63 like a jet, and a droplet guidance part 74, which is supported by a first support 75 and controls the flow of the material N.

Figure 15A:
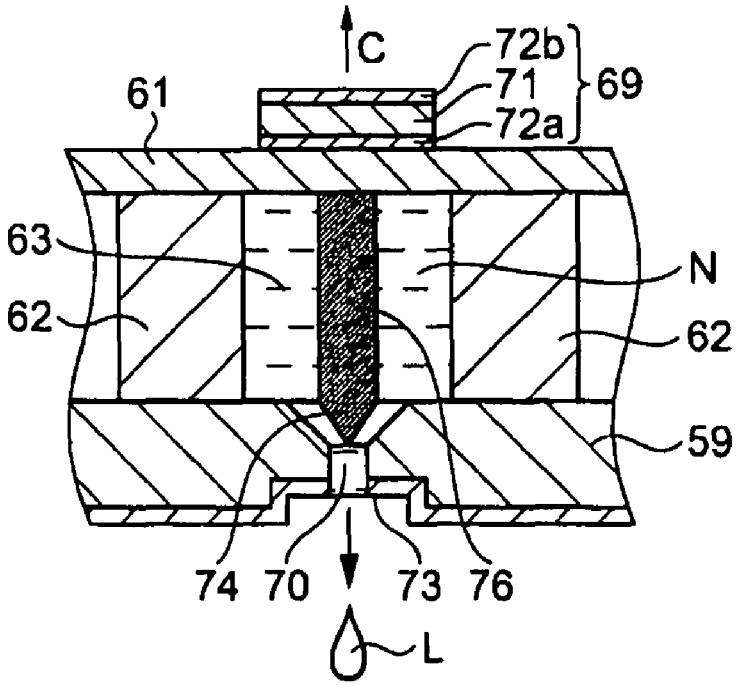
FIGS. 15A and 15B are sectional views illustrating another structure of a droplet discharging head.
Figure 15B:
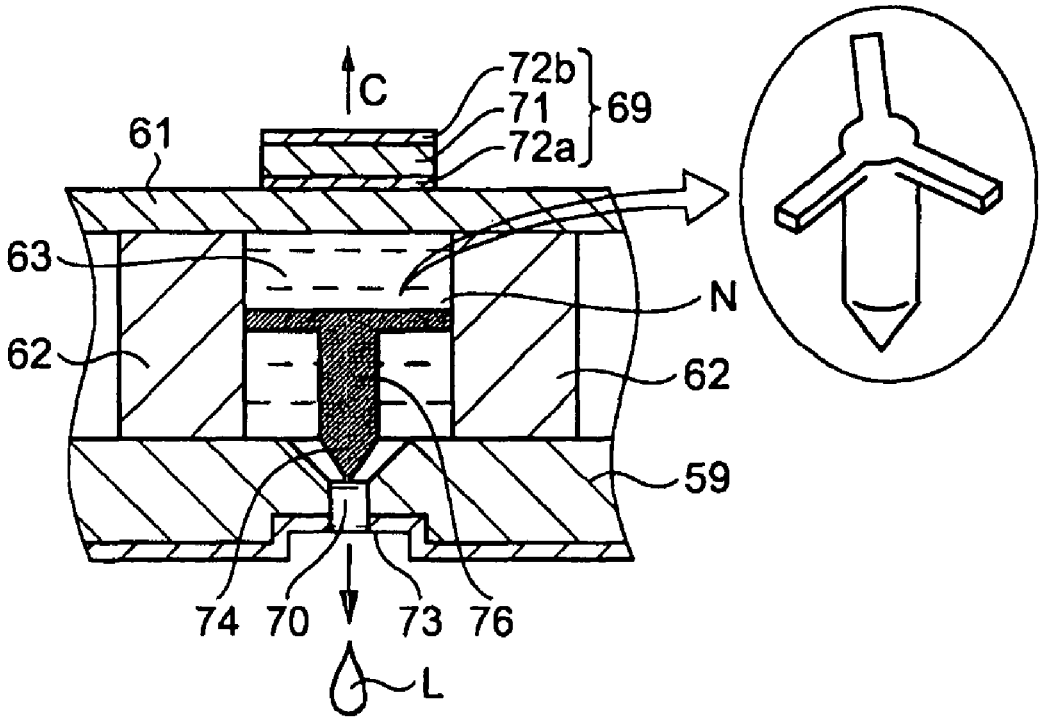

Instead of the first support 75, a support 76 can be used for fixing the droplet guidance part 74 to the vibration plate 61 as shown in FIG. 15C. FIG. 15C is a sectional view illustrating another structure of the droplet discharging head. This fixing method can guide a droplet with suppressing turbulence of a droplet flow compared to the case of using the first support 7 5 for fixing the droplet guidance part 74.

Additionally, the second support 76 can be fixed to a sidewall facing the nozzle plate 59 by changing the position of the vibration plate 61 facing the nozzle plate 59. In this case, a mass addition is avoided that is caused by providing the droplet guidance part 794 and the second support 76 to the vibration plate 61. The droplet guidance part 74 can be supported without influencing a droplet discharge movement.

Additionally, as shown in FIG. 15D, the second support 76 used for fixing the droplet guidance part 74 can be fixed to the partition 62 serving as the sidewall of the pressure chamber 63 by branching the second support 76 in the pressure chamber 63. FIG. 15D is a sectional view illustrating another structure of the droplet discharging head. This fixing method can guide a droplet only by the sidewall of the pressure chamber 63 with suppressing turbulence of a droplet flow caused by the location change of the vibration plate 61f or the forming the support. In this case, the second support 76 can be supported by the vibration plate 61 when the vibration plate 61 is disposed to the sidewall of the pressure chamber 63. While the embodiment is described based on a case in which the droplet guidance part 74 is supported by the first support 75, a case of using the second support 76 can also be followed in the same manner.

A material pressurization member 69 is fixed on a surface, opposite to a surface facing the pressure chamber 63, of the vibration plate 61 so as to correspond the pressure chamber 63. The material pressurization member 69 includes a piezoelectric element 71, and a pair of electrodes 72*a* and 72*b* sandwiching the piezoelectric element 71. The piezoelectric element 71 deforms to bulge outwardly as shown with the arrow C by energizing the electrodes 79*a* and 72*b*. The deformation increases the volume of the pressure chamber 63. As a result, the material N flows in the pressure camber 63 from the liquid reservoir 64 though the passage 68 by an amount equivalent to the increased volume.

Upon stopping energization to the piezoelectric element 71, the piezoelectric element 71 and the vibration plate 61 are put back to the original shape, resulting in the volume of the pressure chamber 63 being put back to the original. This recovery increases the pressure of the material N inside the pressure chamber 63. As a result, the material N is discharged from the penetration part 70 as a droplet.

Here, the material pressurization member 69 may employ a structure of using electrostatic charges instead of the piezoelectric element. In order to avoid the occurrence of flight curve of the droplet L, and clogging the penetration part 70 and the like, a repellent material layer 73 composed of Ni-tetrafluoroethylene eutectoid plating layer, for example, is formed in the vicinity of the penetration part 70.

Next, a method for manufacturing the droplet discharging head of the embodiment will be simply described with reference to FIGS. 14A and 14B. First, the droplet guidance part 74 is fixed to the penetration part 70 of the nozzle plate 59 with the first support 75. Then, the partition 62 and the vibration plate 61 are integrally fixed to the nozzle plate 59 so as to form the droplet discharging head 80.

While the penetration part 710 composed by combining a truncated cone shape and a cylindrical columnar shape is used in the embodiment, the penetration part 70 composed by combining two cylindrical columnar shapes may be used as described in the second embodiment. In addition, the shapes described in a first modification (described later) may also be used. Further, the shape of the droplet guidance part 74 is not limited to a conical shape or a cylindrical columnar shape. The shapes described in the second modification (described later) may also be used.

Seventh Embodiment

Figure 16:
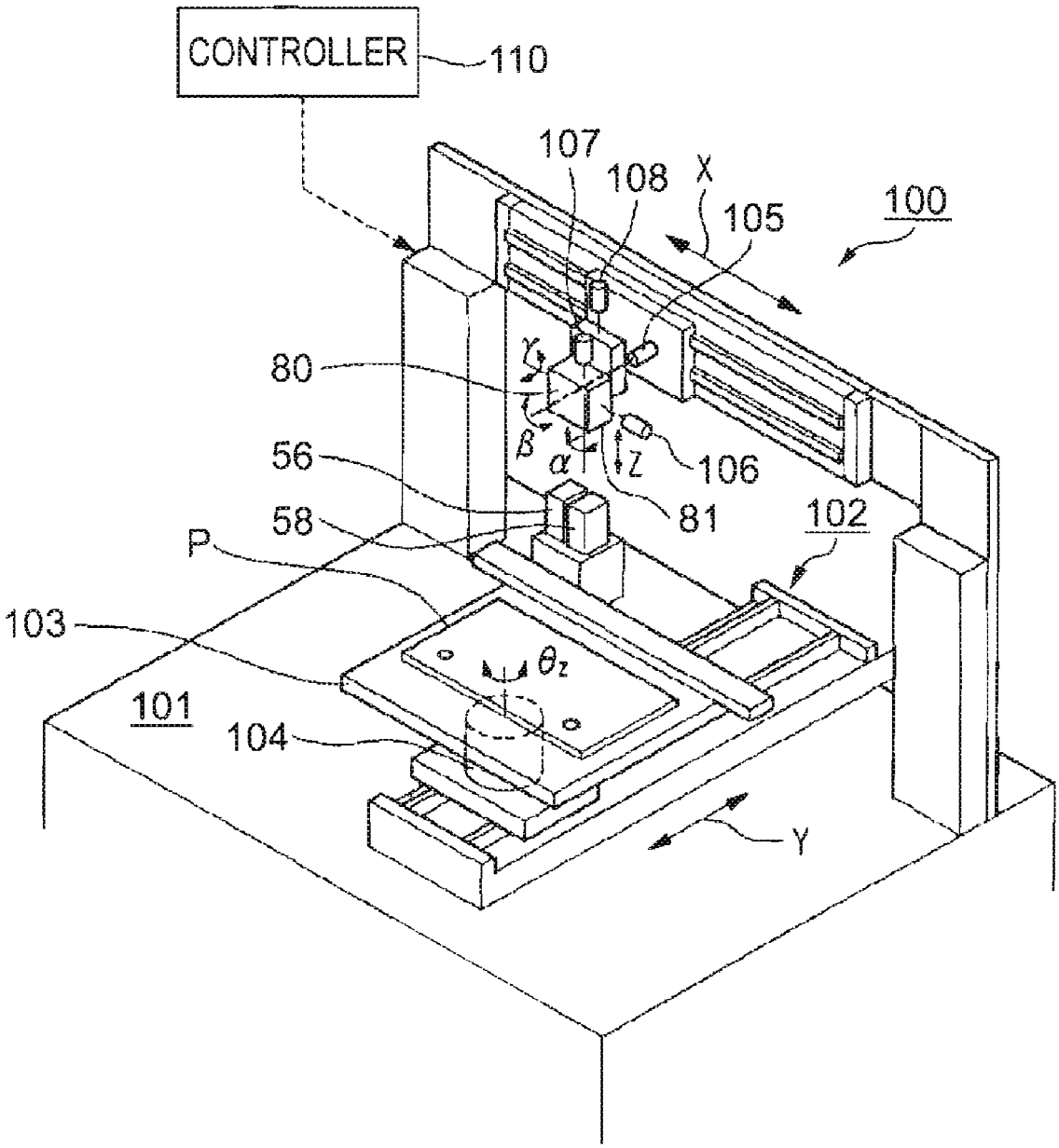
FIG. 16 is a schematic perspective view of a droplet discharging device.

A droplet discharging device according to a seventh embodiment of the invention will now be described. FIG. 16 is a perspective view illustrating a droplet discharging device 100. In FIG. 16, an X direction is the right-and-left direction of a base 101, a Y direction is the back and forth direction, and a Z direction is the up and down direction. The droplet discharging device 100 is mainly constituted by the droplet discharging head 80 and a table 103 on which a substrate P is placed. The movement of the droplet discharging device 100 is controlled by a controller 11(0.

The table 103 placing the substrate P is allowed to move and to be positioned in the Y direction by a first moving means 102, and is allowed to oscillate and to be positioned in a θz direction by a motor 104. On the other hand, the droplet discharging head 80 is allowed to move and to be positioned in the X direction by a second moving means, and is allowed to move and to be positioned in the Z direction by a linear motor 108. The droplet discharging head 80 is allowed to oscillate and to be positioned in α,β, and γ directions by motors 105, 106, and 107, respectively. Accordingly, the droplet discharging device 100 can accurately control the position and attitude of a discharge face 81 of the droplet discharging head 80 relative to the substrate P on the table 103.

A capping unit 56, shown in FIG. 16, caps the discharge face 81 at the time of standby of the droplet discharging device 100 to prevent the discharge face 81 of the droplet discharging head 80 from being dried. A cleaning unit 58 sucks the inside of the discharge part to remove clogs in the discharge part of the droplet discharging head 80. The cleaning unit 58 can also wipe the discharge face 81 to remove the dirt on the discharge face 81 of the droplet discharging head 80.

The droplet discharging device 100 can achieve highly accurate drawings since the droplet discharging head 80 is mounted that can improve the landing position accuracy of the droplet L. When the droplet discharging device 100 is used for a printing device such as an inkjet printer that uses the droplet L as ink, the printing device can improve its printing quality.

First Modification

In the first embodiment, the shape of combining the truncated cone shape part 11 and the cylindrical columnar part 12 shown in FIGS. 1A and 1B is exemplified as a part of the penetration part. In the second embodiment, the shape of combining the first cylindrical columnar part 31 and the second cylindrical columnar part 32 shown in FIGS. 5A and 5B is exemplified as a part of the penetration part. They are only exemplified. The shape is not limited to these examples.

Instead of the above examples, the following exemplified shapes may be employed: a polygon, including a regular polygon, pyramid; a conical shape having a star shape cross-section; and a shape excluding the tip part of a conical shape having a oval shape cross-section. The shape is not limited to a conical shape. A polygon prism including a regular polygon prism, a column having a star shape cross-section, and a column having an oval shape cross-section may be used. Additionally, a shape of connecting columnar and conical shapes in a plurality of numbers may be employed. In this regard, connecting them so as to form a shape tapering towards a droplet discharge side is preferable since the shape allows a droplet to flow without interruption. Further, a uniform or nonuniform groove may de formed inside the conical or columnar shapes.

A shape of connecting a columnar shape having the same cross-section of an area exposed from the above conical shape after cutting off the tip part thereof may be employed for substituting the cylindrical columnar part 12 shown in FIGS. 1A and 1B, and the second cylindrical columnar part 32 shown in FIGS. 5A and 5B. In addition, a shape different from the cross-section shape of the area exposed from the above conical shape after cutting off the tip part thereof may be employed. Further, a uniform or nonuniform groove may be formed inside the columnar shapes.

Furthermore, the axisymmetric pattern is not necessarily required. A pattern having no symmetric axis of rotation can be used. In this case, a droplet is released from a fixed position of the penetration part upon discharging the droplet. As a result, repeatability of landing position can be improved.

Second Modification

In the first and second embodiments, the droplet guidance part having a conical or a cylindrical columnar shape is described. However, another shape such as a truncated cone shape, which is a shape of excluding the tip part of a conical shape, may be used. Additionally, the following shapes may be used: pyramids of polygons including regular polygons; a conical shape having a star shape cross-section; a conical shape having an oval shape cross-section; and a shape excluding the tip part of the conical shapes. Further, the following shapes may be used: cylindrical columns; polygon columns including regular polygon columns; a column having a star shape cross-section; a column having an oval shape cross-section; and a shape having a bulging part. Furthermore, the axisymmetric pattern is not necessarily required. A pattern having no symmetric axis of rotation can be used. In this case, a droplet is released from a fixed position of the droplet guidance part upon discharging the droplet. As a result, repeatability of landing position can be improved. Further, the above shapes may be used by additionally forming a uniform or nonuniform groove inside thereof. The formed groove enhances a droplet releasing property, making it possible to discharge a droplet with high straight flying property.

Third Modification

In the fourth embodiment, the manufacturing method for forming the droplet guidance part by dry etching is described. The droplet guidance part has a pattern with a peak such as a conical shape or an axisymmetric pattern such as a cylindrical columnar shape. Using the dry etching technique can form various patterns. For example, by only changing the plane shape of the photoresist layer 42 used in step 9, the following shapes can be achieved: polygons including regular polygons; a conical shape having a star shape cross-section, an oval shape cross-section, or the like; and a shape excluding the tip part of a conical shape. Additionally, using a pattern asymmetric to rotation for the shape of the photoresist layer 42, a conical pattern asymmetric to rotation can be achieved.

Likewise, various columnar shapes, each having a cross-section of such as polygons including regular polygons, a star, and an oval shapes can be achieved by performing an anisotropic etching without removing the side surface of the photoresist layer 42 in step 3 of the fourth embodiment. Additionally, using a pattern asymmetric to rotation for the shape of the photoresist layer 42, a columnar pattern asymmetric to rotation can be achieved.

Fourth Modification

The first and second supports are exemplified each of which supports the droplet guidance part mainly with three beams. The number of beams, however, is not limited to three. The droplet guidance part can be supported by other than three beams. For example, single beam, two beams, or more than three beams may be employed. Additionally, the first and second supports are not limited to a shape having a beam. For example, a plane shape having a through hole for a droplet passing through it may be employed.

Each of the first and second supports includes the circular constructional member at a fixing end thereof. The circular constructional member is not essential. For example, employing a shape excluding the constructional member for supporting the droplet guidance part can reduce a fixing area. The shape of the constructional member is not limited to a round shape, a polygon shape such as a triangle and a quadrangle shapes may be used. Additionally, the following exemplified shapes may be used: rectangle, trapezoid, inequilateral triangle, and oval. Among them, quadrangle and rectangular shapes are preferably used since the droplet guidance part can be cut off together with the support by dicing or the like.

The entire disclosure of Japanese Patent Application No. 2006-2811,34, filed on Oct. 16, 2006, is expressly incorporated by reference herein.

What is claimed is:

1. A droplet discharging head, comprising:

a pressure chamber;

a nozzle plate including a penetration part that couples with the pressure chamber and discharges a droplet; and a droplet guidance part having a tip, at least a part of the tip being positioned inside the penetration part, the at least a part of the tip being separated from an inside wall of the penetration part, the penetration part including:

a tapered shape part tapering toward a droplet discharging direction; and a columnar shape part coupled with a small end of the tapered shape.

2. The droplet discharging head according to claim 1, the tapered shape having a truncated cone shape part tapering toward the droplet discharging direction and the columnar shape part having a cylindrical columnar shape coupled with a small end of the truncated cone shape part, wherein the truncated cone shape part and the columnar shape part are disposed one of coaxially and eccentrically.

3. The droplet discharging head according to claim 1, wherein the droplet guidance part has an axisymmetric pattern.

4. The droplet discharging head according to claim 1, wherein the tip of the droplet guidance part is positioned within a thickness of the nozzle plate.

5. The droplet discharging head according to claim 1, wherein the droplet ,guidance part has a first support supporting the droplet guidance part and fixing the droplet guidance part to the first surface of the nozzle plate.

6. The droplet discharging head according to claim 5, the droplet guidance part having a second support extending toward the pressure chamber so as to be fixed on a wall of the pressure chamber, the wall facing the nozzle plate.

7. A method for manufacturing the droplet discharging head according to claim 6, the method comprising:

forming the droplet guidance part and the second support; and fixing the droplet guidance part on the wall of the pressure chamber with the second support interposed between the droplet guidance part and the wall.

8. The method for manufacturing the droplet discharging head according to claim 7 wherein the droplet guidance part having the first support and the droplet guidance part having the second support are formed by using one of a dry etching method, a light-forming method, and an ion beam forming method.

9. The droplet discharging head according to claim 5, wherein the droplet guidance part has a second support that extends toward the pressure chamber and one of bends or branches in the pressure chamber so as to be fixed on a sidewall of the pressure chamber.

10. A method for manufacturing the droplet discharging head according to claim 5, the method comprising:

forming the droplet guidance part having the first support; and fixing the first support on the first surface of the nozzle plate.

11. A droplet discharging device comprising the droplet discharging head according to claim 1.

12. A droplet discharging head, comprising:

a pressure chamber;

a nozzle plate including a penetration part that couples with the pressure chamber and discharges a droplet; and a droplet guidance part having a tip, at least a part of the tip being positioned inside the penetration part, the at least a part of the tip being separated from an inside wall of the penetration part, the penetration part including:

a first columnar shape part that is disposed to a first surface of the nozzle plate and has a first cross-sectional shape, the first surface facing the pressure chamber; and a second columnar shape part that is disposed to a discharge surface of the nozzle plate and has a second cross-sectional.

13. The droplet discharging head according to claim 12, the first columnar shape part being a first cylindrical columnar shape having a first radius and the second columnar shape part being a second cylindrical columnar shape having a second radius smaller than the first radius, wherein the first columnar shape part and the second columnar shape part are disposed one of coaxially and eccentrically.

14. A droplet discharging head, comprising:

a pressure chamber;

a nozzle plate including a penetration part that couples with the pressure chamber and discharges a droplet; and a droplet guidance part having a tip, at least a part of the tip being positioned inside the penetration part, the at least a part of the tip being separated from an inside wall of the penetration part, wherein the droplet guidance part is disposed within the thickness of the nozzle plate, and including an axisymmetric pattern with a peaked shape tapering toward the droplet discharging direction, a truncated cone shape tapering toward the droplet discharging direction, a cylindrical columnar shape, and a shape having a bulging part.

* * * * *